United States Patent [19]

Berry

[11] 4,355,573

[45] Oct. 26, 1982

[54] CONTINUOUS PRESS FOR DEHYDRATING PULPS

[75] Inventor: Jean-Luc Berry, Compiegne, France

[73] Assignee: Gie Valpron, France

[21] Appl. No.: 211,689

[22] Filed: Dec. 1, 1980

[51] Int. Cl.[3] ..... B30B 9/20

[52] U.S. Cl. ..... 100/121; 100/157

[58] Field of Search ..... 100/157, 174, 177, 90, 100/121; 68/98

[56] References Cited

U.S. PATENT DOCUMENTS

| | | | |
|---|---|---|---|
| 390,651 | 10/1888 | Crawford | 100/157 X |
| 1,140,683 | 5/1915 | Johansen | 100/157 |
| 1,686,096 | 10/1928 | Manning | 100/90 X |
| 3,969,802 | 7/1976 | Bouvet | 100/121 X |

*Primary Examiner*—Peter Feldman

*Attorney, Agent, or Firm*—Steinberg & Raskin

[57] ABSTRACT

The present invention relates to a continuous press constituted by a central wheel jointly rotatable with a shaft driven at low speed, and the rim is provided with bearing and guiding means for a movable external crown whose internal diameter is greater than the external diameter of the rim, constituting in association a rotary assembly of two cylinders internally substantially tangent to one another, at least one of the two cylinders being perforated, the external crown being applied radially against the rim of the internal wheel by means of a device bearing upon the wheel or its shaft, constituted essentially by two spools rotating freely about their shafts and externally tangent to the external crown and by a system of production and transmission of the tightening effort, not driven in rotation.

7 Claims, 2 Drawing Figures

CONTINUOUS PRESS FOR DEHYDRATING PULPS

The present invention, which is the result of research work performed by Mr. Jean-Luc BERRY, relates to a continuous press intended to extract, by pressing, the juice of industrial products such as beet or apple pulps, green fodder, with a view to either recovering the said juice or increasing the dry-matter content of the product in order to reduce the consumption of energy during the final drying.

Several types of presses are already used, either of the endless-screw type rotating within a stationary perforated cylinder allowing the discharge of the liquid separated by means of the pressure due to the action of the screw, or of the parallel-axis cylinders type operating in the same manner as the cylinders of rolling mills, ensuring a series of successive high pressures of a very short duration, the discharge of the liquid taking place through orifices of various shapes and dimensions provided in one or more cylinders.

Such apparatus offer certain advantages such as the advantage of continuous operation, but also suffer from drawbacks such as the power to be used and the absence of any possibility of regulating the pressure, in the case of the first type, or the duration of reduced pressure and the almost immediate re-absorption by the pressed product of a portion of the separated liquid, in the case of the second type.

The machine according to the invention is a continuous press of novel design allowing in particular an adjustable and known pressure to be applied during a long time to the product supplied in a thin layer to facilitate the expulsion of the liquid besides completely discharged at the very moment of its expulsion, and this without any stirring of the product likely to disturb the expulsion of the liquid.

A continuous press according to the invention is constituted by a central wheel jointly rotatable with a shaft driven at low speed, and the rim of which is provided with bearing and guiding means for a movable external crown whose internal diameter is greater than the external diameter of the rim constituting in association a rotary assembly of two cylinders substantially tangent internally, at least one of the two cylinders being perforated, the external crown being applied radially against the rim of the internal wheel by means of a device bearing upon the wheel or its shaft, constituted essentially by two spools rotating freely about their shafts and externally tangent to the external crown, and by a system of production and transmission of the tightening effort, not driven in rotation.

According to a characterizing feature of the invention, the tightening effort applied to the central wheel will be oriented along a direction variable from the upper vertical to amply beyond the horizontal.

According to a preferred form of embodiment of the invention, the periphery of the rim of the central wheel displays a profile with an undulated generatrix and the interior of the external crown also displays a similar profile with an undulated generatrix, and corresponding to that of the rim.

According to another characterizing feature of the invention, the external ring is constituted by a belt of perforated sheet metal reinforced by external ring-shaped members serving as bearing means for the perforated metal sheet and concentric therewith.

According to still another characterizing feature of the invention, stationary or movable wiping, absorbing, sucking or blowing means for removing the separated liquid in the vicinity of the point of maximum pressure are placed outside the external crown preferably between the spools and between the ring-shaped members reinforcing the belt.

According to another characterizing feature, the external profile of the ring-shaped members of the belt has the shape of double, mutually opposed truncated cones and the external profile of the spools also has the shape of double, mutually opposed truncated cones, corresponding to the external profile of the ring-shaped members.

According to still another characterizing feature of the invention, either one or both spools transmitting the tightening effort to the ring-shaped members are driven in rotation in a direction and at a speed corresponding to the direction and the speed of rotation of the central wheel.

According to another characterizing feature of the invention, the system of production and transmission of the tightening effort is constituted by two pairs of levers located on either side of the assembly movable in rotation, the first pair of levers being mounted on the shaft of the wheel but rotating freely with respect to the latter, the second pair of levers being connected to the supports of the spools in the form of bogies, both pairs of levers being pivotally mounted at one of their ends about a common pivot and carrying at their other end a system of mechanical, hydraulic or pneumatic tightening tending to urge them toward one another, the said tightening system being either adjustable or calibrated.

An example of embodiment of a pressing machine according to the present invention will now be described with reference to FIGS. 1 and 2 of the appended non-limited drawings.

Figure 1:
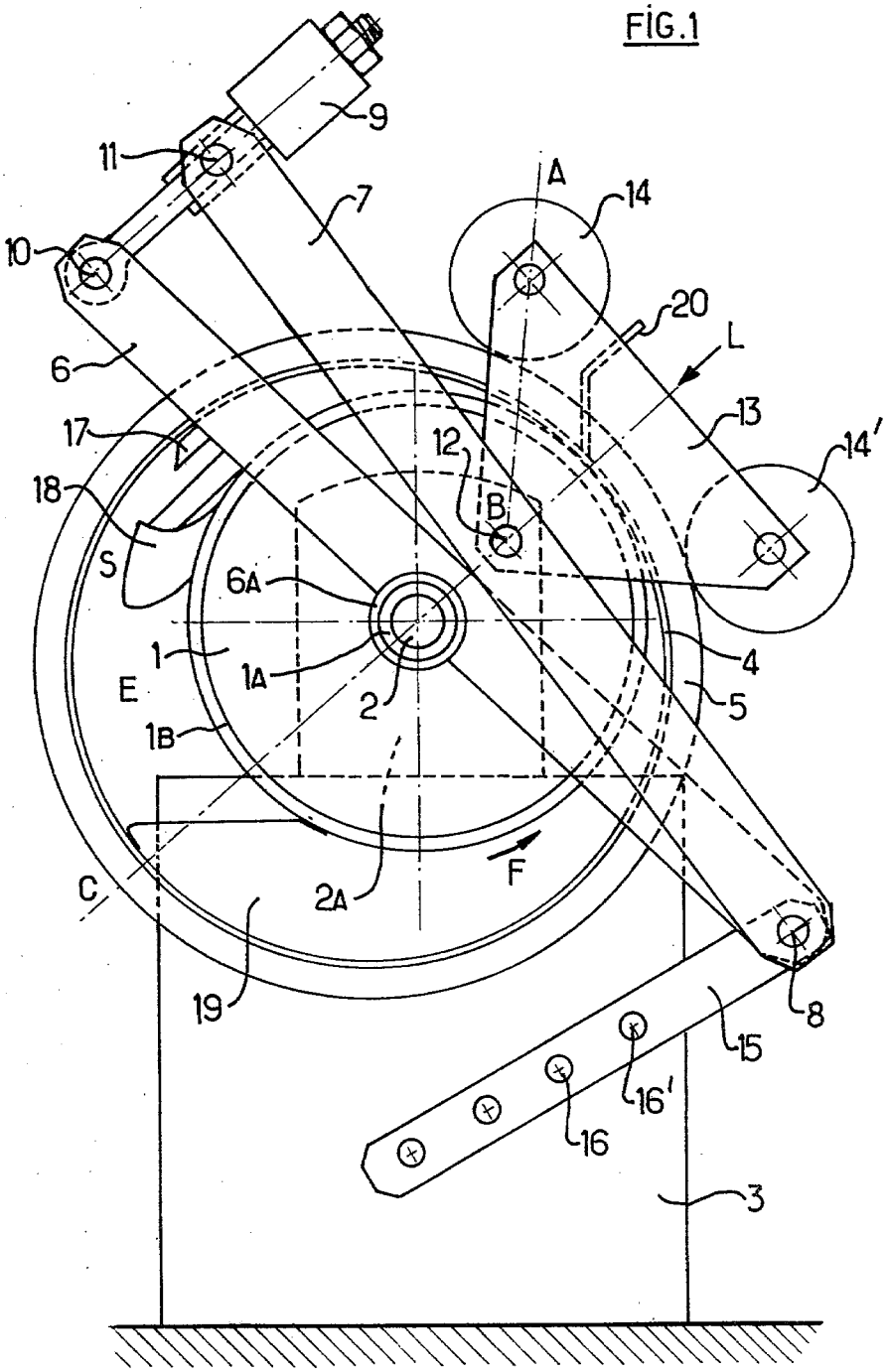
FIG. 1 is a diagrammatic elevational view of the press according to the invention.
Figure 2:
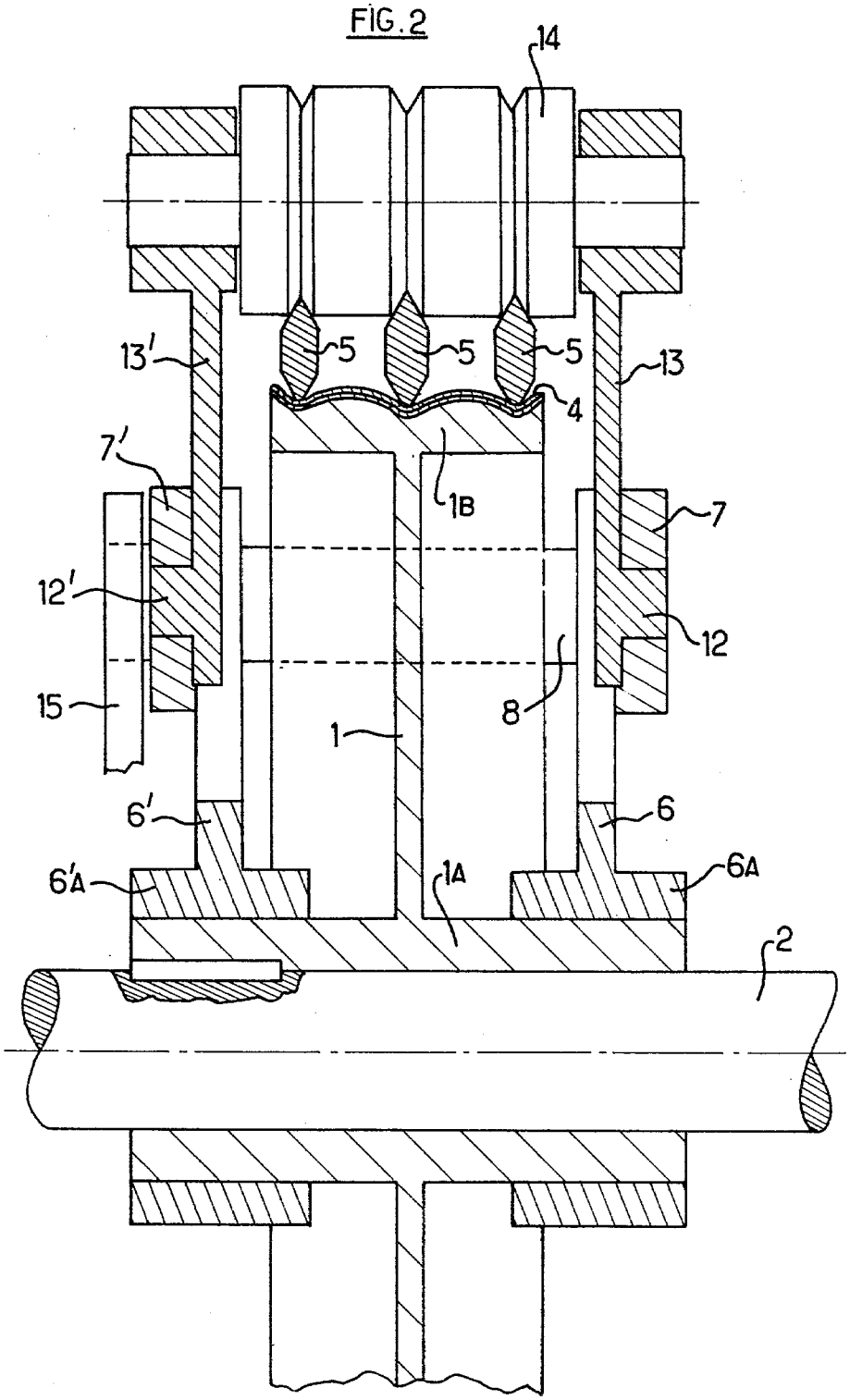
FIG. 2 shows a partial sectional view of the press seen from the left according to the points A, B, C of FIG. 1, but to a different scale.

The press comprises essentially a central wheel 1 the hub 1A of which is jointly rotatable with a shaft 2 supported and driven in rotation by any known mechanical means, e.g. by a motor-variator 2A diagrammatically illustrated and supported by a support 3.

On the rim 1B of the wheel 1 an external crown constituted by a perforated belt 4 whose internal diameter is slightly greater than the external diameter of the rim 1B, and by one or several external ring-shaped members 5, constitute in association with the central wheel 1 a rotary assembly of two cylinders internally substantially tangent to one another. The external crown is applied by means of two pairs of levers 6 and 6', 7 and 7' located on either side of the central wheel 1 and of the external crown 4, 5, and pivotally connected to one another by means of a pivot pin 8, which under the action of a known mechanical, hydraulic or pneumatic tightening system 9 bear upon the pivots 10 and 11 and tend to move the hubs 6A and 6'A towards the pivots 12 and 12' of the bogies 13 and 13' applying in an equilibrated manner to the spools 14 and 14' a tightening effort approximately directed according to L.

The position of the pivot pin 8 is maintained fixed by means of a return bar 15 fixed at 16 on the support 3 and the useful length of which can be modified by using, for the fixing point 16, holes 16' provided in various positions on the return bar.

According to the position of the hole 16' selected to fix the return bar 15, the orientation of the levers 6 and 6', 7 and 7', and consequently the direction of the tightening effort L may be fixed from a substantially vertical upper position to a position amply beyond the horizontal allowing an adjustment amplitude of the order of 135°.

Flexible scrapers 17 and 18 immobilized with respect to the levers 6 and 6' and stationary deflectors 19 located on either side of the rotary assembly are shown diagrammatically in FIG. 1. Said deflectors laterally close, but for no fluid-tightness purposes, the free space between the central wheel 1 and the external crown 4, 5 over the whole lower portion of the press to a point near the tightening spools 14, 14' carried by the bogies 13, 13'.

One or several blowing or vacuum-sucking devices 20 are placed between the spools 14 and 14' and directed between the ring-shaped members 5 towards the lower part of the press.

The operation of the press is as follows.

The wheel 1 is driven in rotation in the direction of the arrow F, driving practically without sliding the belt 4 and the ring-shaped members 5 applied against the rim 1B by the tightening effort supplied by the system 9 and retransmitted by the levers 6 and 6', 7 and 7' to the spools 14 and 14' which rotate freely while being applied on the periphery of the ring-shaped members 5.

The product to be pressed, impregnated with liquid, is introduced at E by appropriate means, not shown, and is driven in the direction of the arrow F, between the deflectors 19, under the action of the progressive movement towards one another of the wall of the rim 1B and of the perforated metal sheet 4 which move in the same direction and at practically equal linear speeds.

The more the product moves towards the maximum tightening point, the more the space reserved for it is reduced. The tightening effort is therefore progressive and prolonged all along the path of the product. The expulsion of the liquid takes place progressively through the perforated belt 4. As a result of the small angle formed by the walls of the associated cylinders in the rotary assembly, the product does not tend to move back.

The separated liquid streams along the external wall of the perforated belt 4 and moves to the lower point of the apparatus where it can be collected by simple means (not shown).

Towards the end of the operation, the product is collected into a thin non-stirred layer, which favours a rapid expulsion of an important amount of liquid. This liquid is either expelled towards the lower part of the press by the blowing devices 20 or sucked by means of vacuum sucking devices (not shown). Owing to the tightening system 9 adjustable by conventional means (not shown), a known or calibrated force can be applied at the end of the pressing operation. The pressed product adheres more or less to the walls of the rim 1B and of the perforated metal sheet 4. The flexible scrapers 17 and 18 detach it from these walls and discharge it laterally at the exit point S.

Of course, the invention is by no means limited to the form of embodiment described and illustrated which has been given by way of example only. In particular, it comprises all means constituting technical equivalents to the means described as well as their combinations should the latter be carried out according to its gist and used within the scope of the protection as claimed.

What is claimed is:

1. A continuous press adapted to press products such as vegetables, fruits, fodder or the like, comprising: an external crown; a central wheel mounted for rotation on a shaft and having a diameter smaller than the diameter of said crown, said wheel being mounted within said crown so as to form a rotary assembly of two cylinders internally tangent with respect to each other and between which said products are pressed; at least one support on which freely-rotating spools are mounted, said spools bearing upon the outer circumference of said external crown; and means for tangentially urging said crown and said wheel against one another to impart a contact force between them, said means comprising first and second pairs of levers located on either side of said rotating assembly, said first pair of levers being pivotally mounted on said shaft on which said wheel is mounted and said second pair of levers being pivotally connected to said at least one support on which said spools are mounted, said two pairs of levers being pivotally connected at one of their end regions about a common point, said urging means further comprising an adjustable tightening means provided at the other of the end regions of said pair of levers for urging said respective pairs of levers towards or away from one another for varying the force with which said spools bear upon the outer circumference of said external crown to correspondingly vary the force of contact between said crown and said wheel.

2. The combination of claim 1 further including bar means adjustably fixed on said press, said common pivot which pivotally connects said lever pairs being provided on said bar means, means for adjusting the position of said bar means relative to said press to thereby adjust the position of said common pivot so that the contact force imparted by said spools may be adjustably oriented in direction over a range of about 135° and between a substantially vertical direction corresponding to the highest position of said spool support and a position substantially beyond the horizontal.

3. The combination of claim 1 wherein said external crown comprises a belt formed of perforated metallic sheet material and concentric external ring-shaped members situated in cooperating relationship with said spools.

4. The combination of claim 3 wherein said ring-shaped members have an external profile having the shape of double, mutually opposed truncated cones and wherein said spools have an external profile having the shape of double, mutually opposed truncated cones corresponding to the external profile of said ring-shaped members.

5. The combination of claim 1 wherein said central wheel comprises a rim having a profile having an undulated generatrix and said external crown is internally provided with an undulated profile corresponding to that of said rim.

6. The combination of claim 1 further comprising means located between said spools and said ring-shaped members for removing the liquid expelled from said products.

7. The combination of claim 2 wherein said bar means comprises a bar in which a plurality of holes are formed for fixing the same in various positions on said press.

* * * * *